United States Patent [19]

Aarons

[11] 4,141,191

[45] Feb. 27, 1979

[54] TILE CLIP

[75] Inventor: Raymond J. Aarons, Jindalee, Australia

[73] Assignee: Monier Colourtile Pty. Ltd., Queensland, Australia

[21] Appl. No.: 802,016

[22] Filed: May 31, 1977

[51] Int. Cl.[2] ..... E04B 1/38; E04C 5/00

[52] U.S. Cl. ..... 52/715; 52/545; 52/547; 52/549; 52/550; 52/702

[58] Field of Search ..... 52/359, 360, 362, 546, 52/DIG. 6, 702, 549, 545, 543, 547, 714, 712, 715, 489, 552, 550

[56] References Cited

U.S. PATENT DOCUMENTS

| | | | |
|---|---|---|---|
| 240,729 | 4/1881 | Jones | 52/550 X |
| 1,909,559 | 5/1933 | Wagner | 52/549 X |
| 1,998,688 | 4/1935 | Robinson et al. | 52/361 |
| 2,353,455 | 7/1944 | Gisondi | 52/550 X |
| 2,877,879 | 3/1959 | Johnson | 52/546 |
| 3,232,018 | 2/1966 | MacKean | 52/174 X |
| 3,348,347 | 10/1967 | Berry | 52/684 |
| 3,438,168 | 4/1969 | Tischuk | 52/545 X |
| 3,447,823 | 6/1969 | Gregoire | 52/714 |
| 3,741,068 | 6/1973 | Andruskiewicz | 52/712 X |
| 3,998,019 | 12/1976 | Reinwall, Jr. | 52/545 |
| 4,040,211 | 8/1977 | Witherspoon | 52/549 X |

FOREIGN PATENT DOCUMENTS

| | | | |
|---|---|---|---|
| 264090 | 8/1968 | Austria | 52/684 |
| 2311906 | 12/1976 | Fed. Rep. of Germany | 52/547 |
| 1105653 | 12/1955 | France | 52/550 |
| 142080 | 9/1930 | Switzerland | 52/550 |
| 1042727 | 9/1966 | United Kingdom | 52/684 |

*Primary Examiner*—Leslie Braun

*Attorney, Agent, or Firm*—Maky, Renner, Otto & Boisselle

[57] ABSTRACT

A tile clip for attaching roofing tiles to the tiling battens having a pair of hooks to engage over the edges of both an upper and lower tile to hold both tiles in place. The lower end of the clip may have opposed hooks to engage both side flanges of a metal batten or means to allow the clip to be nailed to a wooden batten.

4 Claims, 3 Drawing Figures

TILE CLIP

BACKGROUND OF THE INVENTION

This invention relates to a clip for attaching tiles in a roof to metal or wooden tiling battens.

Our prior United States patent application Ser. No. 753,109 described a tiling system using metal battens and tile clips.

The clips there described engage at their upper end over an edge of a tile overlapping another tile beneath it, the clip thus holding both tiles via the upper one. The lower end of the prior clip engages one edge flange on the metal batten.

SUMMARY OF THE PRESENT INVENTION

This invention relates to a tile clip which is modified to engage over the edges of both an upper and a lower tile, thus holding both tiles positively in place.

The lower end of the present clip may have opposed hooks which clip over both side flanges of a metal batten, or attachment means for nailing to a wooden batten.

BRIEF DESCRIPTION OF THE DRAWINGS

In order that the invention may be better understood embodiments will be described with reference to the accompanying drawings, in which.

DETAILED DESCRIPTION OF THE INVENTION

Figures 1, 2, 3:
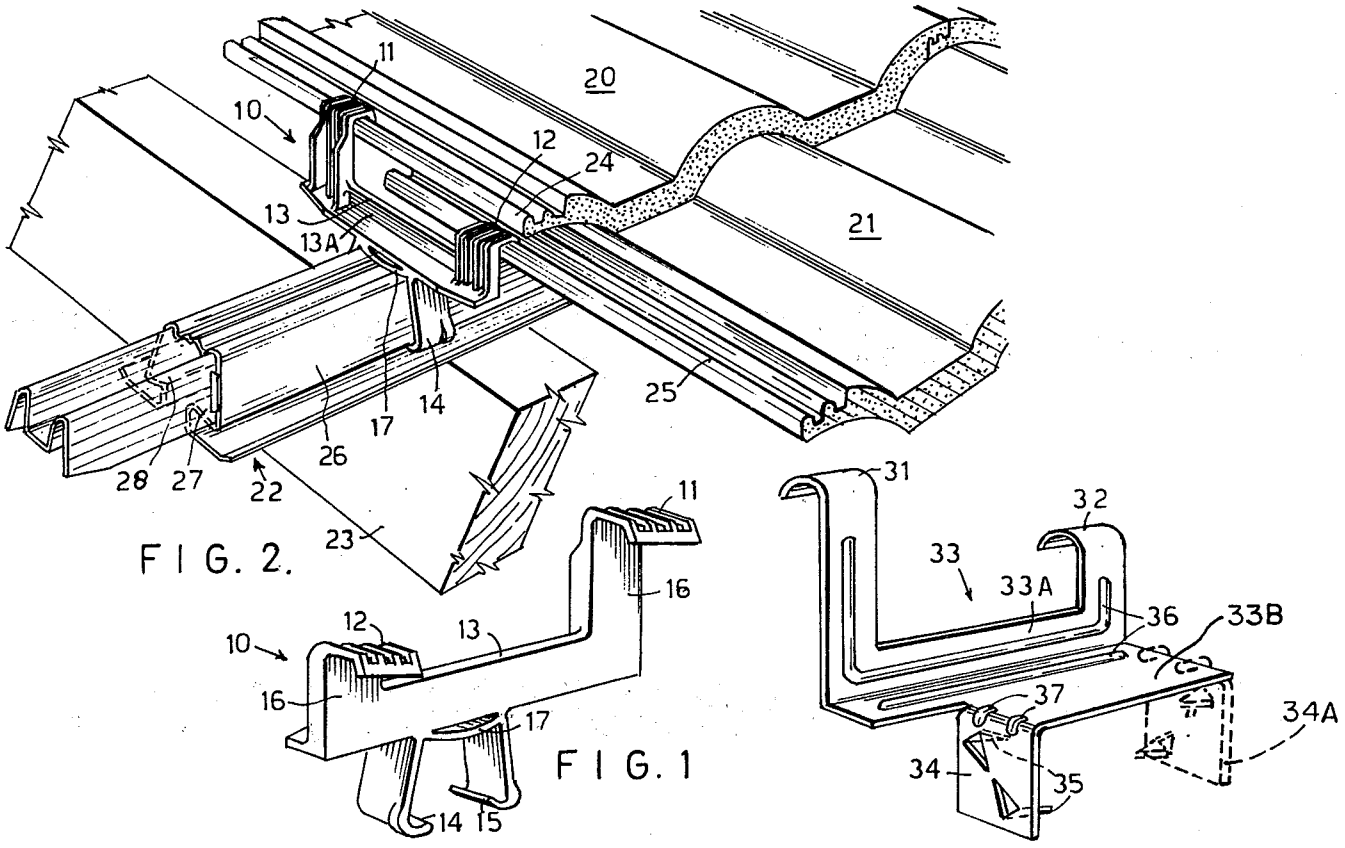
FIG. 1 is a persepctive view of a tile clip for use with metal tile battens.
FIG. 2 shows a clip in use on a tiled roof having a metal tiling batten.
FIG. 3 shows a view similar to FIG. 1 of a modified clip for use with wooden tile battens.

Referring first to FIG. 1, a tile clip 10 of plastic material is shown having upper hooks 11 and 12, a center crosspiece 13 and opposed depending lower hooks 14, 15. Hooks 11, 12, 14, 15 are all resilient, but the body of the clip is made of increased rigidity by thicker ribbed supports 16 joining corresponding upper and lower hooks and by cross-piece 13, having a vertical flange 13A.

Referring to FIG. 2, an upper tile 20 is shown, lapped in the usual way over a lower tile 21 and supported by a metal tile batten 22 attached to roof rafter 23.

The longer hook 11 of clip 10 is engaged over edge bead 24 of tile 20 and the shorter hook 12 over edge bead 25 of tile 21.

Batten 22 has sloped sides 26 and re-entrant slots at each side forming flanges 27, 28.

Hooks 14, 15 of clip 10 engage flanges 27, 28 respectively to retain clip 10 firmly in position with crosspiece 13 lying across the top of batten 22. Pressure membrane 17 ensures positive locking of hooks 14, 15 to flanges 27, 28.

Engagement of clip 10 is easily accomplished by pressing down so that hooks 14, 15 are spread by engagement with sloping sides 26 and then snap resiliently into flanges 27, 28.

The clip described retain both upper tile 20 and lower tile 21 positively in position, and the spaced engagement of hooks 14, 15 on battens 22 gives increased stability and security against disengagement.

Various changes and modifications may be made in the arrangement described without departing from the invention.

The clip of FIG. 3 has hooks 31, 32 corresponding to hooks 11, 12 of FIG. 1 and a rigid crosspiece 33 corresponding to crosspiece 13 of FIG. 1 in this case strengthened by stiffening ribs 36.

Crosspiece 33 has a vertical flange 33A and a horizontal flange 33B.

Since this clip is for use with wooden battens, the batten fastening means are modified.

In place of opposed hooks 14, 15 of FIG. 1 a vertical plate 34 is attached to the edge of flange 33B and carried self-nailing spikes 35.

In use, hooks 31, 32 are engaged over the edge beads of upper and lower tiles as described with reference to FIG. 2 above.

Flange 33B rests on the top of a batten and plate 34 on its side surface. Spikes 35 are driven into the batten to hold the clip. For easier positioning of hooks 13, 32 prior to fastening to the batten, plate 34 may be hinged at 37 to flange 33B.

While it is preferred to use spikes 35 on plate 34, holes in plate 34 may be used to allow ordinary nailing to the batten.

A further similar plate 34A may be provided at the opposite end of flange 33B for attachment to the opposite face of the batten for stronger fastening.

I claim:

1. A tile clip including a body of L shape cross section having a substantially horizontal crosspiece and an integral vertical flange, two resilient spaced tile hooks connected to and extending upwardly from said vertical flange generally in the plane thereof, said tile hooks being dimensioned to engage over the respective side edges of an upper tile and of a lower tile of a pair of overlapped tiles on a roof, reinforcing rib means on said crosspiece and vertical flange to rigidify the same relative to said resilient tile hooks, and fastening means connected to and extending downwardly from said crosspiece including two spaced resilient fastening hooks to engage opposite flanges on a tiling batten and a pressure membrane extending between said resilient fastening hooks immediately below said crosspiece to engage the top of said tiling batten positively to lock the fastening hooks against said opposite flanges on said tiling batten, thereby to fasten the tile clip and overlapping tiles engaged thereby to the tiling batten.

2. A tile clip as set forth in claim 1 wherein said reinforcing rib means includes rigidifying ribs integral with the crosspiece, vertical flange and a portion of said tile hooks.

3. A tile clip including a body of L shape cross section having a substantially horizontal crosspiece and an integral vertical flange, two resilient spaced tile hooks connected to and extending upwardly from said vertical flange generally in the plane thereof, said tile hooks being dimensioned to engage over the respective side edges of an upper tile and of a lower tile of a pair of overlapped tiles on a roof, reinforcing rib means on said crosspiece and vertical flange to rigidify the same relative to said resilient tile hooks, and fastening means connected to and extending downwardly from said crosspiece including a first substantially vertical leg hinged to one side of said crosspiece to lie against a vertical face of a tiling batten while the crosspiece rests on the upper surface of the tiling batten, and means to secure said vertical leg to said vertical face to fasten said tile clip and the tiles engaged thereby to the tiling batten.

4. A tile clip as set forth in claim 3 further including a second substantially vertical leg hingedly connected to the opposite end of said crosspiece from said first substantially vertical leg, said second vertical leg lying against the opposite vertical face of said tiling batten, and means to secure said second vertical leg to said opposite vertical face of said tiling batten.

* * * * *